US011209757B2

(12) United States Patent
Honda

(10) Patent No.: US 11,209,757 B2
(45) Date of Patent: Dec. 28, 2021

(54) FIXING DEVICE WITH SLIDE MEMBER HAVING FIBERS OF DIFFERENT COLORS

(71) Applicant: Ricoh Company, Ltd., Tokyo (JP)

(72) Inventor: Haruyuki Honda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/113,388

(22) Filed: Dec. 7, 2020

(65) Prior Publication Data

US 2021/0173331 A1 Jun. 10, 2021

(30) Foreign Application Priority Data

Dec. 10, 2019 (JP) ..... JP2019-222672

(51) Int. Cl.
*G03G 15/20* (2006.01)

(52) U.S. Cl.
CPC ..... *G03G 15/2025* (2013.01); *G03G 15/2064* (2013.01); *G03G 2215/2038* (2013.01)

(58) Field of Classification Search
USPC ..... 399/328
See application file for complete search history.

(56) References Cited

U.S. PATENT DOCUMENTS

| | | | | |
|---|---|---|---|---|
| 2015/0227096 | A1* | 8/2015 | Nemoto | G03G 15/2053 399/329 |
| 2017/0102646 | A1* | 4/2017 | Ikebuchi | G03G 15/2025 |
| 2017/0176899 | A1 | 6/2017 | Okamoto et al. | |
| 2018/0203384 | A1 | 7/2018 | Okamoto et al. | |
| 2019/0163102 | A1* | 5/2019 | Yang | D03D 11/00 |

FOREIGN PATENT DOCUMENTS

| | | |
|---|---|---|
| JP | 2004-206105 | 7/2004 |
| JP | 2005-062554 | 3/2005 |
| JP | 3111095 | 5/2005 |
| JP | 2005-189599 | 7/2005 |
| JP | 2017-072765 | 4/2017 |
| JP | 2019-168626 | 10/2019 |

* cited by examiner

*Primary Examiner* — Q Grainger
(74) *Attorney, Agent, or Firm* — Xsensus LLP

(57) ABSTRACT

A slide member over which a sliding member is configured to slide includes a slide portion over which the sliding member slides. The slide portion is weaved with a first fiber having a first color. The slide member further includes a non-slide portion over which the sliding member does not slide. The non-slide portion is weaved with a second fiber having a second color that is different and distinguished from the first color.

17 Claims, 8 Drawing Sheets

FIXING DEVICE WITH SLIDE MEMBER HAVING FIBERS OF DIFFERENT COLORS

CROSS-REFERENCE TO RELATED APPLICATION

This patent application is based on and claims priority pursuant to 35 U.S.C. § 119(a) to Japanese Patent Application No. 2019-222672, filed on Dec. 10, 2019, in the Japan Patent Office, the entire disclosure of which is hereby incorporated by reference herein.

BACKGROUND

Technical Field

Exemplary aspects of the present disclosure relate to a slide member, a fixing device, and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device and are requested to meet an increasing market demand for energy saving and high speed image formation. The image forming apparatus forms a toner image on a recording medium such as a recording sheet, printing paper, photosensitive paper, and electrostatic recording paper by an indirect transfer method (e.g., an image transfer method) or a direct transfer method through image forming processes of electrophotographic recording, electrostatic recording, magnetic recording, or the like. The fixing device incorporated in the image forming apparatus heats and presses an unfixed toner image formed on a recording medium, thus fixing the unfixed toner image on the recording medium.

The fixing device includes a fixing rotator (e.g., a fixing belt) that is endless and tubular and a pressure rotator. The fixing rotator and the pressure rotator form a fixing nip where the fixing rotator and the pressure rotator fix the toner image on the recording medium under heat and pressure.

A nip former is disposed inside a loop formed by the fixing rotator. The nip former supports the fixing rotator against pressure from the pressure rotator. A slide member is attached to the nip former. The slide member is applied with a lubricant that reduces a sliding load exerted to the slide member and the fixing rotator while an inner circumferential surface of the fixing rotator slides over the slide member.

The fixing rotator is heated and rotated at a high speed. To address this circumstance, the lubricant applied to the inner circumferential surface of the fixing rotator decreases a resistance that generates while the fixing rotator contacts the slide member at the fixing nip, thus facilitating sliding of the fixing rotator over the slide member and enhancing durability of the fixing rotator and the slide member.

However, the lubricant applied to the slide member decreases over time, increasing friction between the fixing rotator and the slide member and shortening the life of the slide member. As friction between the fixing rotator (e.g., an endless belt) and the slide member (e.g., a slide sheet) increases, a load torque of a driver may increase, resulting in breakage of the driver and damaging of a surface of other element that contacts the driver.

SUMMARY

This specification describes below an improved slide member over which a sliding member is configured to slide. The slide member includes a slide portion over which the sliding member slides. The slide portion is weaved with a first fiber having a first color. The slide member further includes a non-slide portion over which the sliding member does not slide. The non-slide portion is weaved with a second fiber having a second color that is different and distinguished from the first color.

This specification further describes an improved fixing device. In one embodiment, the fixing device includes a fixing rotator that rotates and a pressure rotator that presses against an outer circumferential surface of the fixing rotator. A nip former is disposed opposite an inner circumferential surface of the fixing rotator and disposed opposite the pressure rotator via the fixing rotator to form a nip between the fixing rotator and the pressure rotator. A slide member is sandwiched between the fixing rotator and the nip former. The slide member includes a slide portion over which the fixing rotator slides. The slide portion is weaved with a first fiber having a first color. The slide member further includes a non-slide portion over which the fixing rotator does not slide. The non-slide portion is weaved with a second fiber having a second color that is different and distinguished from the first color.

This specification further describes an improved fixing device. In one embodiment, the fixing device includes a fixing rotator that rotates and a pressure rotator that presses against an outer circumferential surface of the fixing rotator. A nip former is disposed opposite an inner circumferential surface of the fixing rotator and disposed opposite the pressure rotator via the fixing rotator to form a nip between the fixing rotator and the pressure rotator. A slide member is sandwiched between the fixing rotator and the nip former. The slide member includes a slide portion over which the fixing rotator slides. The slide member further includes a non-slide portion over which the fixing rotator does not slide and a first face contacting the fixing rotator. The first face is weaved with a first fiber. The slide member further includes a second face contacting the nip former. The second face is weaved with a second fiber that is exposed on and weaved into at least a part of the non-slide portion on the first face.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
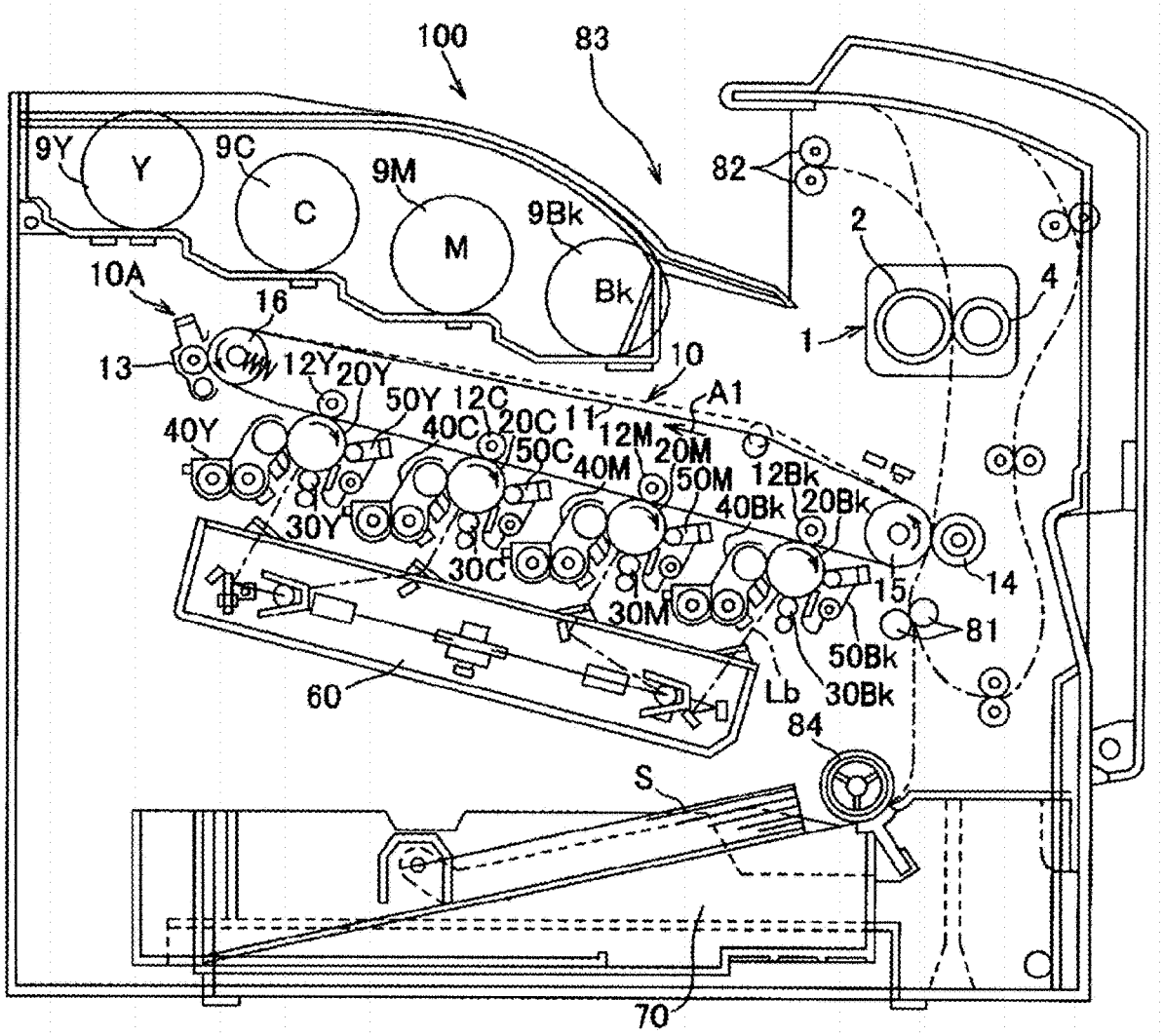
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of a construction of a fixing device and an image forming apparatus according to embodiments of the present disclosure.

The technology of the present disclosure is not limited to the embodiments described below and may be modified within scopes suggested by those skilled in art, such as other embodiments, addition, modification, and deletion. The technology of the present disclosure encompasses various embodiments that achieve operations and advantages of the technology of the present disclosure.

FIG. 1 illustrates an image forming apparatus 100 that is a color printer employing a tandem system in which a plurality of image forming devices that forms images in a plurality of colors, respectively, is aligned in a stretch direction of a transfer belt 11. Alternatively, the image forming apparatus 100 may employ systems other than the tandem system. According to this embodiment, the image forming apparatus 100 is a printer. Alternatively, the image forming apparatus 100 may be a copier, a facsimile machine, or the like.

The image forming apparatus 100 illustrated in FIG. 1 employs the tandem system in which photoconductive drums 20Y, 20C, 20M, and 20Bk are aligned. The photoconductive drums 20Y, 20C, 20M, and 20Bk serve as image bearers that bear images in yellow, cyan, magenta, and black as color separation components, respectively.

In the image forming apparatus 100 having the construction illustrated in FIG. 1, visible images formed on the photoconductive drums 20Y, 20C, 20M, and 20Bk, respectively, are transferred onto the transfer belt 11 in a primary transfer process such that the visible images are superimposed on the transfer belt 11. The transfer belt 11 serves as an intermediate transferor, that is, an endless belt, that rotates in a direction A1 while the transfer belt 11 is disposed opposite the photoconductive drums 20Y, 20C, 20M, and 20Bk. Thereafter, the visible images formed on the transfer belt 11 are transferred collectively onto a recording sheet S (e.g., recording paper) serving as a recording medium in a secondary transfer process.

Each of the photoconductive drums 20Y, 20C, 20M, and 20Bk is surrounded by image forming units that form the visible image as each of the photoconductive drums 20Y, 20C, 20M, and 20Bk rotates. Taking the photoconductive drum 20Bk which forms a black toner image as an example, a charger 30Bk, a developing device 40Bk, a primary transfer roller 12Bk, and a cleaner 50Bk, that form a black toner image, are disposed in a rotation direction of the photoconductive drum 20Bk. Similarly, chargers 30Y, 30C, and 30M, developing devices 40Y, 40C, and 40M, primary transfer rollers 12Y, 12C, and 12M, and cleaners 50Y, 50C, and 50M are disposed in a rotation direction of the photoconductive drums 20Y, 20C, and 20M, respectively. An optical writing device 60 is used for writing with a light beam Lb after the charger 30Bk charges the photoconductive drum 20Bk.

While the transfer belt 11 rotates in the direction A1, the visible images formed on the photoconductive drums 20Y, 20C, 20M, and 20Bk, respectively, are transferred onto the transfer belt 11 such that the visible images are superimposed on a same position on the transfer belt 11. For example, the primary transfer rollers 12Y, 12C, 12M, and 12Bk disposed opposite the photoconductive drums 20Y, 20C, 20M, and 20Bk, respectively, via the transfer belt 11 apply a voltage to transfer the visible images formed on the photoconductive drums 20Y, 20C, 20M, and 20Bk at different times from the upstream photoconductive drum 20Y to the downstream photoconductive drum 20Bk in the direction A1.

The photoconductive drums 20Y, 20C, 20M, and 20Bk are aligned in this order from the upstream photoconductive drum 20Y to the downstream photoconductive drum 20Bk in the direction A1. Imaging stations that form the yellow, cyan, magenta, and black toner images include the photoconductive drums 20Y, 20C, 20M, and 20Bk, respectively.

The image forming apparatus 100 includes four imaging stations, a transfer belt unit 10, a secondary transfer roller 14, a belt cleaner 13, and the optical writing device 60. The four imaging stations form yellow, cyan, magenta, and black toner images, respectively. The transfer belt unit 10 is disposed opposite and above the photoconductive drums 20Y, 20C, 20M, and 20Bk. The transfer belt unit 10 includes the transfer belt 11 and the primary transfer rollers 12Y, 12C, 12M, and 12Bk. The secondary transfer roller 14 serves as a transferor or a transfer roller that is disposed opposite the transfer belt 11 and rotates in accordance with rotation of the transfer belt 11. The belt cleaner 13 is disposed opposite the transfer belt 11 and cleans a surface of the transfer belt 11 as an intermediate transfer belt. The optical writing device 60 serves as an optical writer disposed opposite and below the four imaging stations.

The optical writing device 60 includes a semiconductor laser serving as a light source, a coupling lens, an f-θ lens, a toroidal lens, a reflection mirror, and a polygon mirror serving as a deflector. The optical writing device 60 emits laser beams Lb that correspond to yellow, cyan, magenta, and black image data onto the photoconductive drums 20Y, 20C, 20M, and 20Bk, forming electrostatic latent images on the photoconductive drums 20Y, 20C, 20M, and 20Bk, respectively. Although FIG. 1 illustrates the laser beam Lb directed to the imaging station that forms the black toner image, the laser beams Lb are also directed to the imaging stations that form the yellow, cyan, and magenta toner images, respectively.

The image forming apparatus 100 further includes a sheet feeder 70, a registration roller pair 81, and a sensor. The sheet feeder 70 is a sheet feeding tray (e.g., a paper tray) that loads recording sheets S to be conveyed to a secondary transfer nip formed between the secondary transfer roller 14 and the transfer belt 11. The registration roller pair 81 feeds the recording sheet S conveyed from the sheet feeder 70 toward the secondary transfer nip formed between the secondary transfer roller 14 and the transfer belt 11 at a predetermined time when the yellow, cyan, magenta, and black toner images formed on the transfer belt 11 by the imaging stations reach the secondary transfer nip. The sensor detects that a leading edge of the recording sheet S reaches the registration roller pair 81.

The image forming apparatus 100 further includes a fixing device 1, a sheet ejection roller pair 82, a sheet ejection tray 83, and toner bottles 9Y, 9C, 9M, and 9Bk. The fixing device 1 is a fuser that fixes a color toner image on the recording sheet S by a belt fixing system. The color toner image is formed by transferring the yellow, cyan, magenta, and black toner images formed on the transfer belt 11 onto the recording sheet S. The sheet ejection roller pair 82 ejects the recording sheet S bearing the fixed color toner image onto an outside of a body of the image forming apparatus 100. The sheet ejection tray 83 (e.g., an output tray) is disposed atop the body of the image forming apparatus 100. The sheet ejection tray 83 stacks the recording sheets S ejected onto the outside of the body of the image forming apparatus 100 by the sheet ejection roller pair 82. The toner bottles 9Y, 9C, 9M, and 9Bk are disposed below the sheet ejection tray 83 and replenished with yellow, cyan, magenta, and black toners, respectively.

In addition to the transfer belt 11 and the primary transfer rollers 12Y, 12C, 12M, and 12Bk, the transfer belt unit 10 includes a driving roller 15 and a driven roller 16 over which the transfer belt 11 is looped.

The driven roller 16 also serves as a tension applicator that applies tension to the transfer belt 11. Hence, a biasing member such as a spring biases the driven roller 16 against the transfer belt 11. The transfer belt unit 10, the primary transfer rollers 12Y, 12C, 12M, and 12Bk, the secondary transfer roller 14, and the belt cleaner 13 construct a transfer device 10A.

The sheet feeder 70 is disposed in a lower portion of the body of the image forming apparatus 100. The sheet feeder 70 includes a sheet feeding roller 84 that comes into contact with an upper surface of an uppermost recording sheet S and feeds the uppermost recording sheet S. As the sheet feeding roller 84 is driven and rotated counterclockwise in FIG. 1, the sheet feeding roller 84 feeds the uppermost recording sheet S to the registration roller pair 81.

The belt cleaner 13 installed in the transfer device 10A, although the belt cleaner 13 is schematically illustrated in FIG. 1, includes a cleaning brush and a cleaning blade that are disposed opposite and brought into contact with the transfer belt 11. The cleaning brush and the cleaning blade scrape and remove a foreign substance such as residual toner from the transfer belt 11, cleaning the transfer belt 11.

The belt cleaner 13 further includes a discharging device that conveys the residual toner removed from the transfer belt 11 for disposal.

The image forming apparatus 100 further includes a control panel used by a user to operate an entirety of the image forming apparatus 100 and a controller that controls the entirety of the image forming apparatus 100.

When the controller determines that the number of the recording sheets S conveyed through the fixing device 1, the operation time of the fixing device 1, the number of rotations of a fixing rotator 2 of the fixing device 1, or the like reaches a predetermined value or greater, the controller controls the control panel to display a maintenance notice that instructs the user to perform maintenance of the fixing rotator 2. Thus, the control panel serves as a display. For example, the controller controls the control panel to display whether or not maintenance of the fixing rotator 2 is needed at a predetermined operation interval. When the controller determines that maintenance of the fixing rotator 2 has been performed, the controller controls the control panel to finish displaying the maintenance notice and resumes counting the number of the recording sheets S conveyed through the fixing device 1, the operation time of the fixing device 1, the number of rotations of the fixing rotator 2, and the like.

Figure 2:
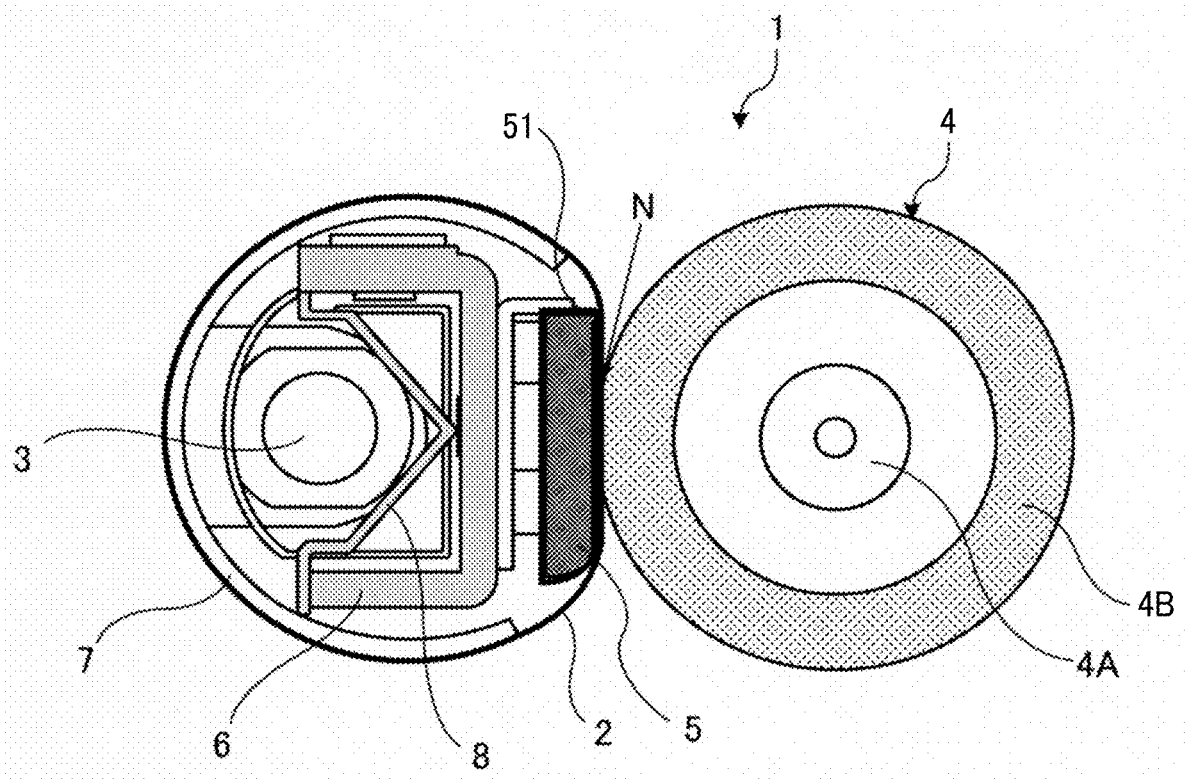
FIG. 2 is a schematic cross-sectional view of a fixing device incorporated in the image forming apparatus depicted in FIG. 1.

FIG. 2 illustrates the fixing device 1 according to an embodiment of the present disclosure.

The fixing device 1 incorporated in the image forming apparatus 100 according to this embodiment includes the fixing rotator 2, a pressure rotator 4, a nip former 5, and a slide member 51. The fixing rotator 2 serving as a fixing member or a sliding member is rotatable and fixes an unfixed toner image on a recording sheet S serving as a recording medium. The pressure rotator 4 serving as a pressure member presses against an outer circumferential surface of the fixing rotator 2. The nip former 5 (e.g., a nip formation pad) is disposed opposite an inner circumferential surface of the fixing rotator 2. The nip former 5 is disposed opposite the pressure rotator 4 via the fixing rotator 2 to form a fixing nip N between the fixing rotator 2 and the pressure rotator 4. The slide member 51 is sandwiched between the fixing rotator 2 and the nip former 5 and is wrapped around the nip former 5. The slide member 51 includes a slide portion applied with a lubricant. The fixing rotator 2 slides over the slide portion of the slide member 51.

A detailed description is now given of a construction of the fixing rotator 2.

The fixing rotator 2 is an endless belt or film that is tubular and made of metal such as nickel and stainless used steel (SUS) or resin such as polyimide, for example. The fixing rotator 2 includes a base and a release layer. The release layer serves as a surface layer made of perfluoroalkoxy alkane (PFA), polytetrafluoroethylene (PTFE), or the like, facilitating separation of the recording sheet S from the fixing rotator 2 and preventing toner from adhering to the fixing rotator 2. Optionally, an elastic layer made of silicone rubber or the like may be interposed between the base and the release layer. If the fixing rotator 2 does not incorporate the elastic layer, the fixing rotator 2 attains a decreased thermal capacity that improves a fixing property of being heated quickly. However, when the pressure rotator 4 presses and deforms an unfixed toner image to fix the toner image on the recording sheet S, slight surface asperities of the fixing rotator 2 may be transferred onto the toner image, causing an orange peel mark to remain on a solid part of the toner image as uneven gloss of the toner image or an orange peel image. In order to prevent this, the fixing rotator 2 preferably incorporates the elastic layer having a thickness of 100 μm or greater. As the elastic layer deforms, the elastic layer absorbs the slight surface asperities, preventing the orange peel mark on the toner image.

A support 6 (e.g., a stay) that supports the nip former 5 is disposed inside a loop formed by the fixing rotator 2. The support 6 prevents the nip former 5 from being bent by pressure from the pressure rotator 4, attaining a uniform length of the fixing nip N in a recording sheet conveyance direction in which the recording sheet S is conveyed throughout an entire length of the fixing rotator 2 in an axial direction thereof.

The fixing device 1 further includes a reflector 8 that is interposed between a heat source 3 and the support 6. The reflector 8 reflects radiant heat and the like from the heat source 3, suppressing heating of the support 6 with radiant heat and the like and resultant waste of energy. Alternatively, instead of the reflector 8, a surface of the support 6 may be treated with thermal insulation or mirror finish to attain similar advantages.

According to this embodiment, as illustrated in FIG. 2, the heat source 3 is a halogen heater. Alternatively, an induction heater (IH), a resistive heat generator, a carbon heater, or the like may be used. The heat source 3 is disposed opposite the inner circumferential surface of the fixing rotator 2 and heats the fixing rotator 2 directly. If the heat source 3 is the halogen heater, the fixing device 1 may incorporate a light shielding plate 7. The light shielding plate 7 shields the fixing rotator 2 from light emitted from the halogen heater so that the halogen heater heats the fixing rotator 2 within a span corresponding to a size of the recording sheet S. The light shielding plate 7 includes a plurality of light passing portions (e.g., apertures) corresponding to a plurality of sizes of recording sheets S, respectively. For example, as the light shielding plate 7 pivots, an appropriate light passing portion corresponding to a size of a recording sheet S is situated between the heat source 3 and the fixing rotator 2.

A detailed description is now given of a construction of the pressure rotator 4.

The pressure rotator 4 includes a cored bar 4A, an elastic rubber layer 4B, and a release layer. The elastic rubber layer 4B is disposed on an outer surface of the cored bar 4A. The release layer made of PFA or PTFE is disposed on a surface of the elastic rubber layer 4B. The release layer facilitates separation of the recording sheet S from the pressure rotator 4. A driving force is transmitted to the pressure rotator 4 from a driver such as a motor disposed in the image forming apparatus 100 depicted in FIG. 1 through a gear, thus rotating the pressure rotator 4. A spring or the like presses the pressure rotator 4 against the fixing rotator 2. As the spring presses and deforms the elastic rubber layer 4B, the pressure rotator 4 forms the fixing nip N having a predetermined length in the recording sheet conveyance direction.

The pressure rotator 4 is a pressure roller. The pressure roller may be a hollow roller. A heat source such as a halogen heater may be disposed inside the pressure rotator 4 as the hollow roller. The elastic rubber layer 4B may be made of solid rubber. Alternatively, if no heater is disposed inside the pressure rotator 4, sponge rubber may be used. The sponge rubber enhances thermal insulation of the pressure rotator 4, preferably causing the pressure rotator 4 to draw less heat from the fixing rotator 2.

A detailed description is now given of a configuration of the nip former 5.

The nip former 5 is disposed inside the loop formed by the fixing rotator 2. For example, the nip former 5 is disposed opposite the pressure rotator 4 via the fixing rotator 2. Thus, the fixing rotator 2 and the pressure rotator 4 that are disposed opposite each other define the fixing nip N therebetween. As a recording sheet S bearing a toner image transferred from the transfer belt 11 is conveyed through the fixing nip N, the fixing rotator 2 and the pressure rotator 4 fix the toner image on the recording sheet S under heat and pressure.

As illustrated in FIG. 2, the fixing nip N is planar. Alternatively, the fixing nip N may be curved or concave or may have other shapes. If the fixing nip N is concave, the fixing nip N directs the leading edge of the recording sheet S to the pressure rotator 4 when the recording sheet S is ejected from the fixing nip N, facilitating separation of the recording sheet S from the fixing rotator 2 and thereby preventing the recording sheet S from being jammed.

A detailed description is now given of a configuration of the slide member 51.

The slide member 51 is sandwiched between the fixing rotator 2 and the nip former 5 and is in contact with the inner circumferential surface of the fixing rotator 2, that is disposed opposite the nip former 5. The slide member 51 is wrapped around the nip former 5. The slide member 51 is secured to the nip former 5 with at least one of an adhesive and a fastener. The adhesive is double-sided tape, for example. The fastener is a screw, for example.

The slide member 51 is impregnated with the lubricant that is supplied to the inner circumferential surface of the fixing rotator 2. For example, silicone oil, grease, or the like is used as the lubricant.

The configuration of the slide member 51 is described below in more detail.

The fixing rotator 2 rotates in accordance with rotation of the pressure rotator 4. With the construction of the fixing device 1 illustrated in FIG. 2, as the driver drives and rotates the pressure rotator 4, the driving force is transmitted from the pressure rotator 4 to the fixing rotator 2 at the fixing nip N, rotating the fixing rotator 2 in accordance with rotation of the pressure rotator 4. The fixing rotator 2 rotates while the nip former 5 and the pressure rotator 4 sandwich the fixing rotator 2 at the fixing nip N. The fixing rotator 2 rotates while holders inserted into both lateral ends of the fixing rotator 2 in the axial direction thereof, respectively, guide the fixing rotator 2 in a circumferential span of the fixing rotator 2 other than the fixing nip N.

A description is provided of a construction of a comparative fixing device.

The comparative fixing device includes a fixing belt and a slide member that retains a decreased resistance between the slide member and the fixing belt that slides over the slide member, prevents a lubricant from leaking from the slide member, and attains an enhanced durability. The slide member provides a plurality of embodiments.

The slide member is made of fabric. An arrangement of fibers and a method of weaving are properly selected to attain a desired function of the slide member.

Under an environment in which the slide member provides the plurality of embodiments, in a case in which different slide members before and after a specification change are manufactured concurrently in an identical factory, for example, a measure to prevent a proper slide member from being confused with a wrong slide member and prevent the wrong slide member from being installed into a target fixing device erroneously when the fixing device is assembled is requested. For example, if the slide member before the specification change and the slide member after the specification change have an identical shape or are not distinguished from each other easily by an external appearance, the measure is needed.

As a measure to prevent the proper slide member from being confused with the wrong slide member and prevent the wrong slide member from being installed into the target fixing device erroneously, the shape of the slide member or a target member (e.g., a nip former) around which the slide member is wrapped may be changed, for example.

However, the measure may increase the number of processes and costs for design changes and may add adjustment for change in assembling, for example. Additionally, change in the shape of the slide member may hinder the slide member from being shared among fixing devices of different models.

Referring to FIGS. 3A, 3B, 4A, and 4B, a description is provided of the configuration of the slide member 51 of the fixing device 1 in more detail.

Figure 3A:
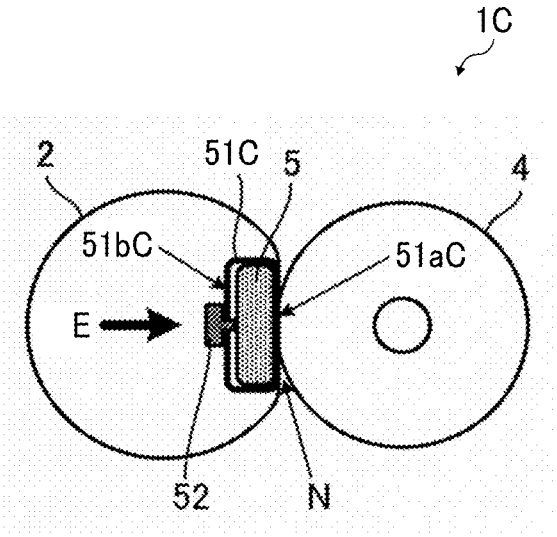
FIG. 3A is a schematic cross-sectional view of a comparative fixing device.
Figure 3B:
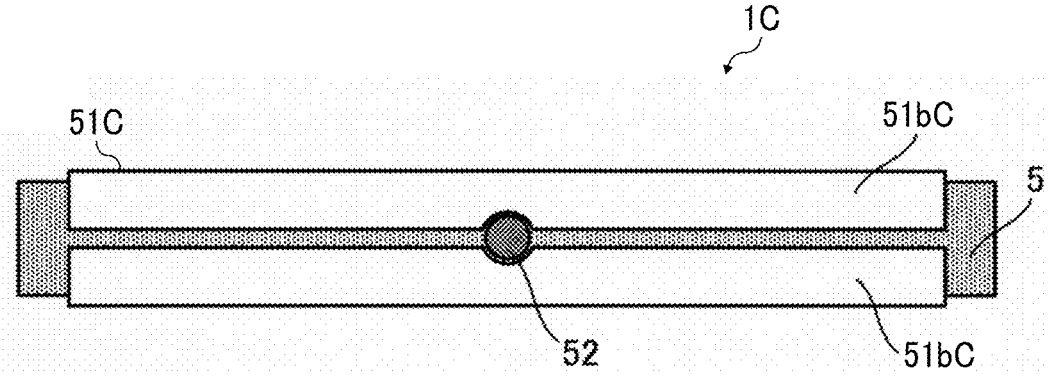
FIG. 3B is a plan view of a main section of the comparative fixing device depicted in FIG. 3A.
Figure 4A:
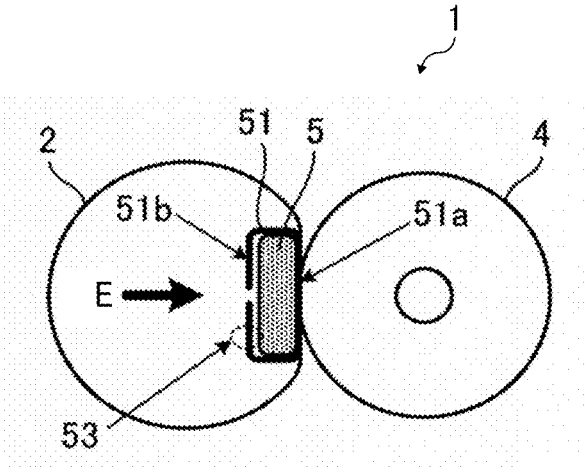
FIG. 4A is a schematic cross-sectional view of the fixing device depicted in FIG. 2.
Figure 4B:
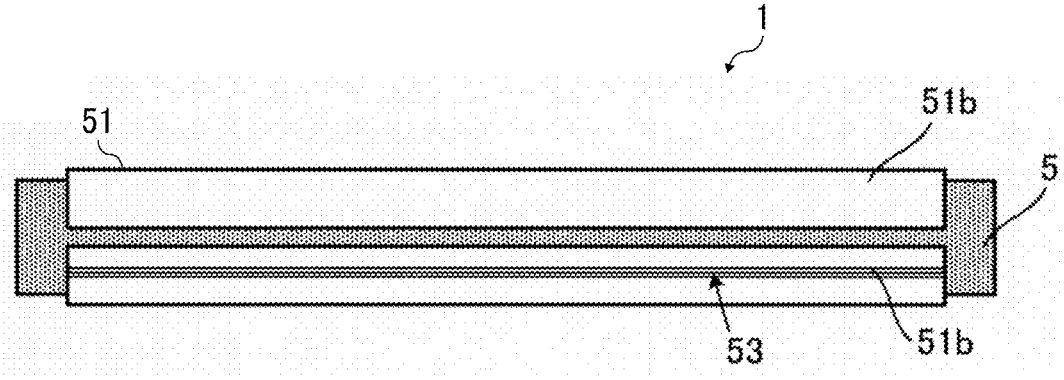
FIG. 4B is a plan view of a main section of the fixing device depicted in FIG. 4A.

FIGS. 3A and 3B illustrate a fixing device 1C according to a comparative example. FIGS. 4A and 4B illustrate the fixing device 1 according to an embodiment of the present disclosure.

FIG. 3A is a cross-sectional view of a main section of the fixing device 1C. FIG. 4A is a cross-sectional view of a main section of the fixing device 1. FIG. 3B is a plan view of a slide member 51C and the nip former 5 of the fixing device 1C, seen in a direction E in FIG. 3A. FIG. 4B is a plan view of the slide member 51 and the nip former 5 of the fixing device 1, seen in the direction E in FIG. 4A.

As illustrated in FIGS. 3A and 3B, the slide member 51C includes a slide portion 51*a*C over which the fixing rotator 2 slides and a non-slide portion 51*b*C over which the fixing rotator 2 does not slide. As illustrated in FIGS. 4A and 4B, the slide member 51 includes a slide portion 51*a* over which the fixing rotator 2 slides and a non-slide portion 51*b* over which the fixing rotator 2 does not slide.

As illustrated in FIGS. 3A and 3B, the fixing device 1C includes a projection 52 that prevents erroneous installation of the slide member 51C. The slide member 51C has a shape that fits the projection 52, thus being immune from erroneous installation.

However, the fixing device 1C does not accept a slide member having a shape different from the shape of the slide member 51C. Additionally, the fixing device 1C increases the number of processes and costs for design changes caused by addition of the projection 52 and modification in the shape of the slide member 51C to fit the projection 52. Further, the fixing device 1C adds adjustment for change in assembling.

Conversely, as illustrated in FIGS. 4A and 4B, the slide member 51 of the fixing device 1 according to this embodiment is made of fabric constructed of fibers in a plurality of colors, respectively. According to a first embodiment of the present disclosure, a distinguishing fiber 53 having a color different from a color of a fiber of the slide portion 51*a* is weaved into the non-slide portion 51*b* over which the fixing rotator 2 does not slide such that the distinguishing fiber 53 is distinguishable.

Figure 5A:
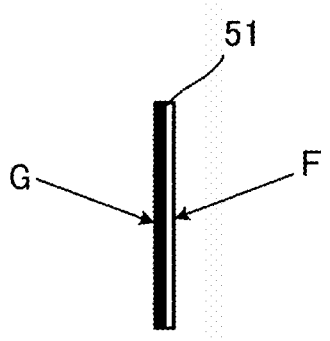
FIG. 5A is a cross-sectional view of a slide member incorporated in the fixing device depicted in FIG. 4A, illustrating a front face and a back face of the slide member.
Figure 5B:
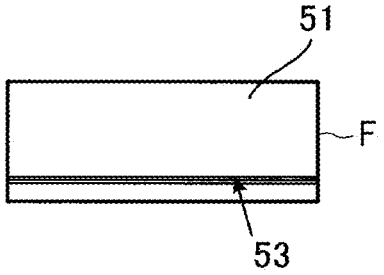
FIG. 5B is a diagram of the front face of the slide member depicted in FIG. 5A, illustrating a distinguishing fiber thereon.
Figure 5C:
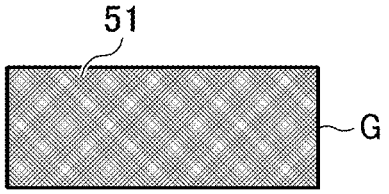
FIG. 5C is a diagram of the back face of the slide member depicted in FIG. 5A.

As illustrated in FIGS. 5A, 5B, and 5C, the slide member 51 includes a front face F and a back face G. The front face F contacts the fixing rotator 2 and includes a first fiber. The back face G contacts the nip former 5 and includes a second fiber. Thus, the slide member 51 is made of fabric constructed of the first fiber and the second fiber. According to a second embodiment of the present disclosure, as illustrated in FIG. 5B, the second fiber (e.g., the distinguishing fiber 53) is weaved into at least a part of the non-slide portion 51*b*, over which the fixing rotator 2 does not slide, on the front face F contacting the fixing rotator 2 such that the second fiber is exposed.

For example, since a color of the first fiber is different from a color of the second fiber, the second fiber exposed on and weaved into the non-slide portion 51*b* on the front face F serves as the distinguishing fiber 53.

Accordingly, the fixing device 1 according to the embodiments prevents erroneous installation of the slide member 51 into the fixing device 1 without an extra construction. An external appearance of the slide member 51 allows an engineer to distinguish the slide member 51 from a wrong slide member readily, preventing the engineer from confusing the slide member 51 with the wrong slide member and allowing the engineer to inspect whether or not the slide member 51 is manufactured by weaving according to a specification, for example.

Figure 6:
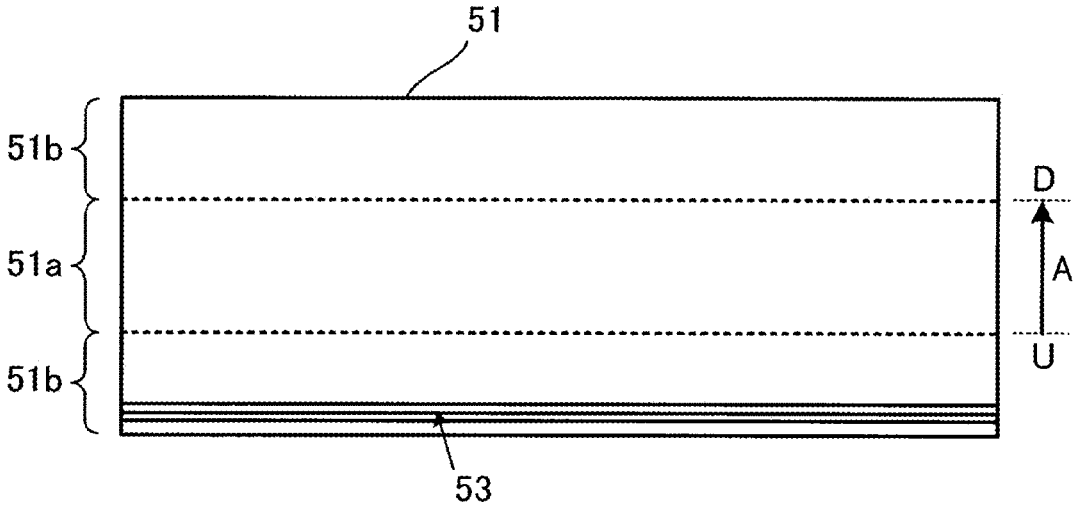
FIG. 6 is a diagram of one example of the slide member depicted in FIG. 5B.

FIG. 6 illustrates the slide member 51 as a first example that is installed in the fixing device 1 according to the embodiments.

As illustrated in FIG. 5A, the slide member 51 is made of fabric constructed of two layers, that is, a first layer made of the first fiber constructing the front face F and a second layer made of the second fiber constructing the back face G. The front face F is coupled with the back face G by a double weave or the like. The first fiber is exposed on the front face F. The second fiber is exposed on the back face G and a part of the front face F. Since the color of the first fiber is different from the color of the second fiber, the second fiber exposed on and weaved into the non-slide portion 51*b* on the front face F serves as the distinguishing fiber 53 as illustrated in FIG. 6.

FIG. 6 illustrates a slide direction A in which the fixing rotator 2 slides over the slide member 51 from an upstream position U to a downstream position D.

The slide member 51 is constructed of threads of warp and weft. The warp is disposed substantially parallel to the slide direction A of the fixing rotator 2. The weft is disposed substantially perpendicular to the slide direction A of the fixing rotator 2. The weft of the second fiber is exposed on and weaved into at least a part of the non-slide portion 51*b* on the front face F.

The weft of the second fiber exposed on and weaved into the non-slide portion 51*b* is disposed at a plurality of positions on the non-slide portion 51*b* of the slide member 51.

The first fiber constructing the front face F of the slide member 51 according to the embodiments is preferably a fiber that has an improved heat resistance and an improved slide property that facilitates sliding of the fixing rotator 2 over the slide member 51. For example, the first fiber is made of PTFE or the like. Conversely, the second fiber constructing the back face G may be a fiber that has a heat resistance and a slide property that are inferior to those of the first fiber. For example, the second fiber is made of polyphenylene sulfide (PPS) or the like prepared at reduced costs. As described above, the slide member 51 is constructed of a combination of the first fiber and the second fiber. The color of the first fiber is different from the color of the second fiber. The second fiber is exposed on the front face F and serves as the distinguishing fiber 53.

If the second fiber having the heat resistance and the slide property that are inferior to those of the first fiber is exposed on the slide portion 51*a*, the slide portion 51*a* may degrade quickly by heat conducted from the fixing rotator 2 and friction between the slide member 51 and the fixing rotator 2 that slides over the slide member 51, shortening the life of the slide member 51. To address this circumstance, the second fiber is preferably exposed on the non-slide portion 51*b*.

For example, the weft of the second fiber is preferably exposed on and weaved into the non-slide portion 51*b* on the front face F.

The weft of the second fiber is exposed on and weaved into the non-slide portion 51*b* at the plurality of positions on the non-slide portion 51*b*, thus improving distinguishment. FIG. 6 illustrates the distinguishing fibers 53 arranged in three lines as one example. However, the positions and the number of the distinguishing fibers 53 that are exposed are not limited to those illustrated in FIG. 6.

Figure 7A:
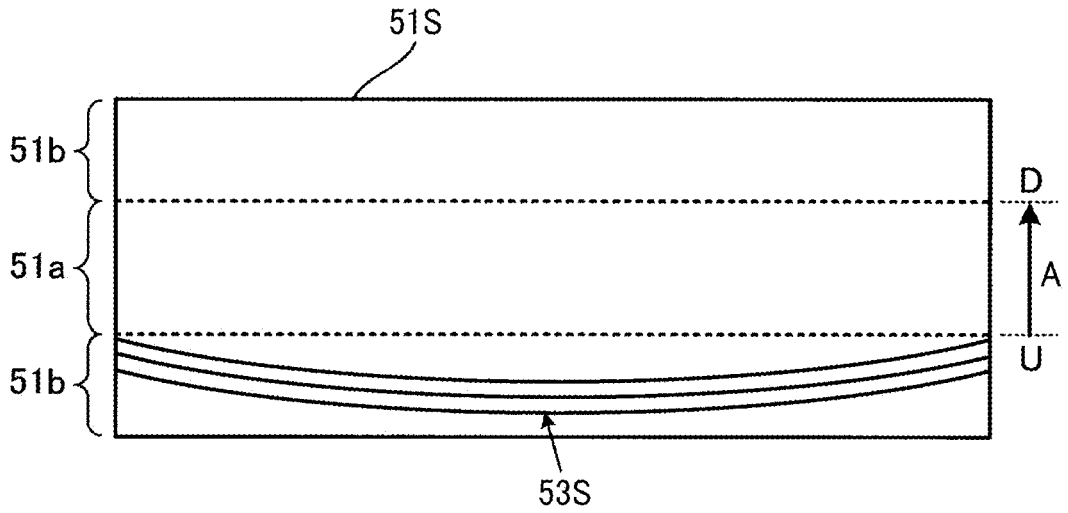
FIG. 7A is a diagram of another example of the slide member depicted in FIG. 5B.
Figure 7B:
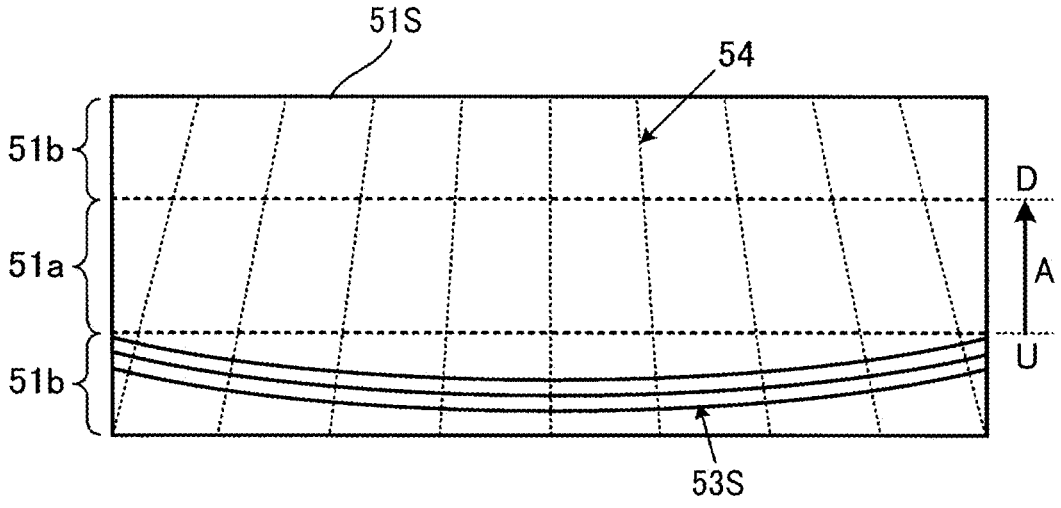
FIG. 7B is a diagram of the slide member depicted in FIG. 7A, illustrating warp constructing the slide member.

FIGS. 7A and 7B illustrate a slide member 51S as a second example that is installable in the fixing device 1 according to the embodiments.

As illustrated in FIG. 5A, each of the slide members 51 and 51S is made of fabric constructed of the two layers, that is, the first layer made of the first fiber constructing the front face F and the second layer made of the second fiber constructing the back face G. The front face F is coupled with the back face G by the double weave or the like. The first fiber is exposed on the front face F. The second fiber is exposed on the back face G and a part of the front face F. Since the color of the first fiber is different from the color of the second fiber, the second fiber exposed on and weaved into the non-slide portion 51*b* on the front face F serves as the distinguishing fiber 53.

As illustrated in FIGS. 7A and 7B, wefts serving as distinguishing fibers 53S are curved with respect to a longitudinal direction of the slide member 51S.

In the slide member 51S according to this embodiment, the wefts serving as the distinguishing fibers 53S are curved with respect to the longitudinal direction of the slide member 51S. Accordingly, an orientation of a warp 54 illustrated with a dotted line in FIG. 7B is inclined with respect to the slide direction A of the fixing rotator 2 directed from the upstream position U to the downstream position D.

A lubricant impregnated in the slide member 51S flows in the orientation of the warp 54. Hence, the slide member 51S according to this embodiment prevents the lubricant from flowing out of the slide member 51S in the longitudinal direction thereof.

In a mass production process of the slide member 51S depicted in FIGS. 7A and 7B, an inclination of the warp 54 is measured based on an amount of curving of the distinguishing fiber 53S. An amount of inclination of the warp 54 varies depending on a position of the warp 54. A measurable length of the warp 54 is also short and varies a measurement result substantially. Hence, the amount of curving of the distinguishing fiber 53S as the weft is preferably measured.

Further, the amount of curving of the weft is adjusted properly so that the slide member 51S is manufactured according to a type of the lubricant and a requested performance of the fixing device 1 into which the slide member 51S is installed. Since an orientation of a fiber is a factor that affects a function of the slide member 51S, the orientation of the fiber is controlled to define a given amount of inclination. With a slide member without the distinguishing fibers 53S, the engineer finds it difficult to visually check and inspect the orientation of the fiber. Conversely, with the slide member 51S according to this embodiment having the distinguishing fibers 53S, the engineer visually checks and inspects the orientation of the fiber with the distinguishing fibers 53S readily, attaining a simple visual inspection.

Similarly, with the slide member 51 according to the embodiment described above with reference to FIG. 6, the engineer performs the simple visual inspection of quality of straightness (e.g., non-curving) and the like of the orientation of the fiber with the distinguishing fibers 53.

FIGS. 8A, 8B, 8C, 8D, and 8E illustrate examples of arrangement of warp and weft of the slide member 51, that are also applicable to the slide member 51S. In FIGS. 8A, 8B, 8C, 8D, and 8E, an upward arrow schematically illustrates the slide direction A in which the fixing rotator 2 slides over the slide member 51. A rightward arrow schematically illustrates a flowing direction B in which the lubricant moves. The flowing direction B is perpendicular to the slide direction A.

The slide member 51 according to the embodiments is made of fabric constructed of fibers in a plurality of colors, respectively. A fiber (e.g., the distinguishing fiber 53) having a color different from a color of a fiber of the slide portion 51*a* is weaved into the non-slide portion 51*b* over which the fixing rotator 2 does not slide such that the distinguishing fiber 53 is distinguishable from the fiber of the slide portion 51*a*. The slide member 51 includes the front face F and the back face G. The front face F contacts the fixing rotator 2 and includes the first fiber. The back face G contacts the nip former 5 and includes the second fiber. Thus, the slide member 51 is made of fabric constructed of the first fiber and the second fiber. As long as the second fiber (e.g., the distinguishing fiber 53) is weaved into at least a part of the non-slide portion 51*b*, over which the fixing rotator 2 does not slide, on the front face F such that the second fiber is exposed, arrangement (e.g., weave) of warp and weft is not restricted.

Figure 8A:
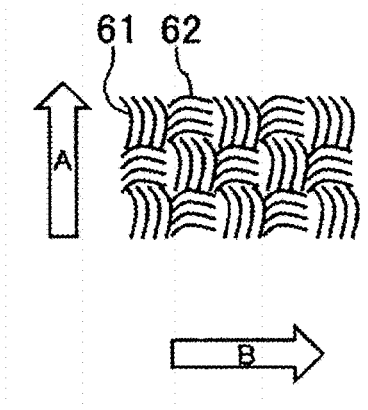
FIG. 8A is a diagram of warp and weft of the slide member depicted in FIG. 6, illustrating a first example of weaving of the warp and the weft.

In the example of the slide member 51 illustrated in FIG. 8A, warp 61 and weft 62 are weaved at an identical amount rate. For example, the number of fibers per unit area is identical between the warp 61 and the weft 62. Additionally, a thickness of the warp 61 is identical to a thickness of the weft 62. However, the lubricant may leak from a lateral end of the slide member 51 in a longitudinal direction thereof easily, decreasing an amount of the lubricant applied on the slide portion 51*a*. To address this circumstance, the slide member 51 is preferably configured as described below with reference to the examples illustrated in FIGS. 8B, 8C, 8D, and 8E, respectively.

Figure 8B:
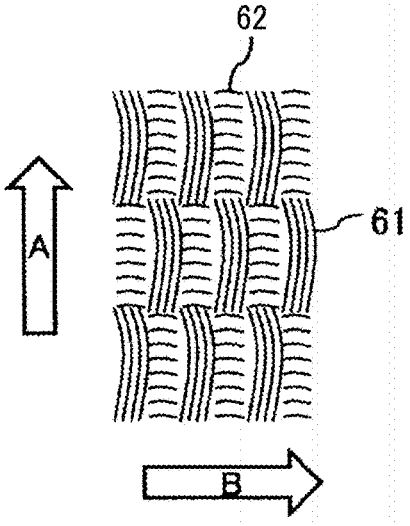
FIG. 8B is a diagram of warp and weft of the slide member depicted in FIG. 6, illustrating a second example of weaving of the warp and the weft.

In the example of the slide member 51 depicted in FIG. 8B, the warp 61 parallel to the slide direction A has a weaving interval that is greater than a weaving interval of the weft 62. Since the weft 62 binds the warp 61 with a decreased binding force, the warp 61 stretches in the flowing direction B in which the weft 62 extends. As a result, an area of the warp 61 is greater than an area of the weft 62, increasing an amount of the lubricant held by the warp 61. For example, the warp 61 is weaved with the weft 62 such that the warp 61, that is parallel to the slide direction A in which the lubricant applied on the front face F disposed opposite the fixing nip N flows, holds the lubricant in an amount per unit area greater than an amount per unit area of the lubricant held by the weft 62 disposed perpendicular to the slide direction A. Since the lubricant held by the warp 61 moves in the slide direction A without stress, the lubricant does not move horizontally in FIG. 8B in the flowing direction B easily and therefore does not leak from the slide member 51 easily. Alternatively, the slide member 51 may attain a combination of the example depicted in FIG. 8B and the example depicted in FIG. 8C, that causes the warp 61 to hold the lubricant in an amount per unit area even greater than an amount per unit area of the lubricant held by the weft 62, while preventing the lubricant from leaking from the slide member 51.

Figure 8C:
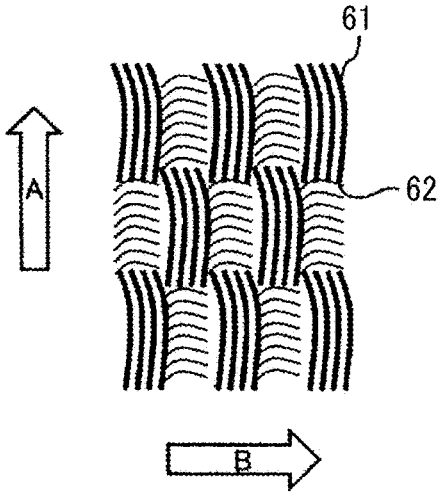
FIG. 8C is a diagram of warp and weft of the slide member depicted in FIG. 6, illustrating a third example of weaving of the warp and the weft.

In the example of the slide member 51 depicted in FIG. 8C, like the example of the slide member 51 depicted in FIG. 8B, the warp 61 parallel to the slide direction A has a weaving interval that is greater than a weaving interval of the weft 62. Additionally, a thickness of the warp 61 is greater than a thickness of the weft 62.

In the example of the slide member 51 depicted in FIG. 8C, the lubricant is held between the warp 61 and the weft 62 readily and is flown in a rotation direction, that is, the slide direction A, of the fixing rotator 2. Accordingly, the lubricant flows in the flowing direction B in a slight amount, thus being immune from leaking from the slide member 51.

Figure 8D:
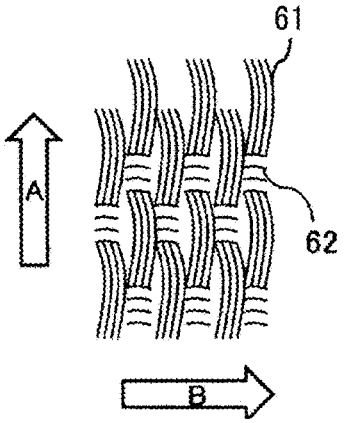
FIG. 8D is a diagram of warp and weft of the slide member depicted in FIG. 6, illustrating a fourth example of weaving of the warp and the weft.

In the example of the slide member 51 depicted in FIG. 8D, the warp 61 parallel to the slide direction A has an amount rate that is greater than an amount rate of the weft 62. For example, the number of threads of the warp 61 per unit area is greater than the number of threads of the weft 62 per unit area.

The weft 62 depicted in FIG. 8D binds the warp 61 with a binding force even smaller than a binding force with which the weft 62 depicted in FIG. 8C binds the warp 61. Accordingly, the lubricant does not move horizontally in FIG. 8D in the flowing direction B easily and therefore does not leak from the slide member 51 even easily.

Alternatively, the slide member 51 may attain a combination of the example depicted in FIG. 8D with at least one of the example depicted in FIG. 8B and the example depicted in FIG. 8C described above. Accordingly, the slide member 51 causes the warp 61 to hold the lubricant in an increased amount per unit area, while preventing the lubricant from leaking from the slide member 51.

Figure 8E:
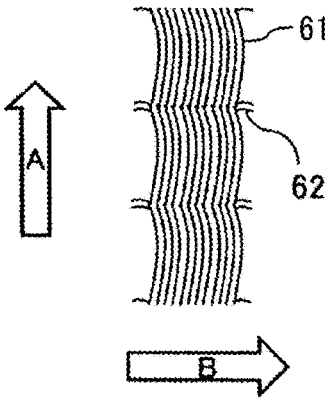
FIG. 8E is a diagram of warp and weft of the slide member depicted in FIG. 6, illustrating a fifth example of weaving of the warp and the weft.

In the example of the slide member 51 depicted in FIG. 8E, fibers are weaved like a Japanese tatami mat. The warp 61 parallel to the slide direction A is exposed on the front face F of the slide member 51, that faces the fixing rotator 2. The weft 62 is not exposed on the front face F of the slide member 51. Hence, the lubricant barely moves in the flowing direction B perpendicular to the slide direction A. Additionally, an amount rate of the weft 62 is smaller than an amount rate of the warp 61, causing the warp 61 to hold an increased amount of the lubricant. Hence, the slide member 51 suppresses leakage of the lubricant.

A description is provided of advantages of a fixing device (e.g., the fixing device 1).

As illustrated in FIGS. 4A, 6, and 7A, the fixing device includes a fixing rotator (e.g., the fixing rotator 2), a pressure rotator (e.g., the pressure rotator 4), a nip former (e.g., the nip former 5), and a slide member (e.g., the slide members 51 and 51S).

The fixing rotator is rotatable and fixes an unfixed toner image on a recording medium (e.g., a recording sheet S). The pressure rotator presses against an outer circumferential surface of the fixing rotator. The nip former is disposed opposite an inner circumferential surface of the fixing rotator and disposed opposite the pressure rotator via the fixing rotator to form a nip (e.g., the fixing nip N) between the fixing rotator and the pressure rotator. The slide member is sandwiched between the fixing rotator and the nip former and is substantially wrapped around the nip former. The slide member includes a slide portion (e.g., the slide portion 51*a*) applied with a lubricant. The fixing rotator slides over the slide portion of the slide member.

According to an embodiment, the slide member is made of fabric constructed of fibers in a plurality of colors, respectively. The slide member further includes a non-slide portion (e.g., the non-slide portion 51*b*) over which the fixing rotator does not slide. The slide portion is weaved with a first fiber having a first color. The non-slide portion is weaved with a second fiber (e.g., the distinguishing fibers 53 and 53S) having a second color that is different and distinguished from the first color.

As illustrated in FIG. 5A, according to another embodiment, the slide member includes a first face (e.g., the front face F) and a second face (e.g., the back face G). The first face contacts the fixing rotator and includes the first fiber. The second face contacts the nip former and includes the second fiber. Thus, the slide member is made of fabric constructed of the first fiber and the second fiber. As illustrated in FIGS. 5B, 6, and 7A, the first face includes the non-slide portion over which the fixing rotator does not slide. The second fiber (e.g., the distinguishing fibers 53 and 53S) is weaved into at least a part of the non-slide portion on the first face such that the second fiber is exposed.

Accordingly, the slide member is distinguished readily from a wrong slide member by an external appearance. Thus, the slide member is not confused with the wrong slide member, preventing the wrong slide member from being installed into the fixing device erroneously.

According to the embodiments described above, a fixing belt (e.g., the fixing rotator 2) serves as a fixing rotator. Alternatively, a fixing film, a fixing sleeve, or the like may be used as a fixing rotator. Further, a pressure roller (e.g., the pressure rotator 4) serves as a pressure rotator. Alternatively, a pressure belt or the like may be used as a pressure rotator.

According to the embodiments described above, the image forming apparatus 100 is a printer. Alternatively, the image forming apparatus 100 may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device, comprising:

a fixing rotator configured to rotate;

a pressure rotator configured to press against an outer circumferential surface of the fixing rotator;

a nip former disposed opposite an inner circumferential surface of the fixing rotator and disposed opposite the pressure rotator via the fixing rotator to form a nip between the fixing rotator and the pressure rotator; and a slide member sandwiched between the fixing rotator and the nip former, the slide member including:

a slide portion over which the fixing rotator slides, the slide portion weaved with a first fiber having a first color; and a non-slide portion over which the fixing rotator does not slide, the non-slide portion weaved with a second fiber having a second color that is different and distinguished from the first color, wherein the second fiber is not exposed on a slide face of the slide portion and is exposed on a non-slide face of the non-slide portion.

2. The fixing device according to claim 1, wherein the slide member is substantially wrapped around the nip former.

3. The fixing device according to claim 2, wherein the slide portion is applied with a lubricant.

4. The fixing device according to claim 1, wherein the slide member is made of fabric.

5. A fixing device, comprising:

a fixing rotator configured to rotate;

a pressure rotator configured to press against an outer circumferential surface of the fixing rotator;

a nip former disposed opposite an inner circumferential surface of the fixing rotator and disposed opposite the pressure rotator via the fixing rotator to form a nip between the fixing rotator and the pressure rotator; and a slide member sandwiched between the fixing rotator and the nip former, the slide member including:

a slide portion over which the fixing rotator slides;

a non-slide portion over which the fixing rotator does not slide;

a first face contacting the fixing rotator, the first face weaved with a first fiber; and a second face contacting the nip former, the second face weaved with a second fiber that is exposed on and weaved into at least a part of the non-slide portion on the first face, wherein the second fiber is not exposed on the first face and is exposed on the second face.

6. The fixing device according to claim 5, wherein the first fiber has a first color and the second fiber has a second color that is different from the first color.

7. The fixing device according to claim 6, wherein the slide member is substantially wrapped around the nip former.

8. The fixing device according to claim 7, wherein the slide portion is applied with a lubricant.

9. The fixing device according to claim 8, wherein the slide member further includes:

warp disposed substantially parallel to a slide direction in which the fixing rotator slides over the slide member; and weft disposed substantially perpendicular to the slide direction of the fixing rotator.

10. The fixing device according to claim 9, wherein the second fiber includes the weft that is exposed on and weaved into at least a part of the non-slide portion on the first face.

11. The fixing device according to claim 10, wherein the weft of the second fiber is disposed at a plurality of positions on the non-slide portion.

12. The fixing device according to claim 10, wherein the weft of the second fiber is curved with respect to a longitudinal direction of the slide member.

13. The fixing device according to claim 9, wherein a weaving interval of the warp is greater than a weaving interval of the weft.

14. The fixing device according to claim 13, wherein a thickness of the warp is greater than a thickness of the weft.

15. The fixing device according to claim 9, wherein a number of threads of the warp per unit area is greater than a number of threads of the weft per unit area.

16. A fixing device, comprising:

a fixing rotator configured to rotate;

a pressure rotator configured to press against an outer circumferential surface of the fixing rotator;

a nip former disposed opposite an inner circumferential surface of the fixing rotator and disposed opposite the pressure rotator via the fixing rotator to form a nip between the fixing rotator and the pressure rotator; and a slide member sandwiched between the fixing rotator and the nip former, the slide member including:

a slide portion over which the fixing rotator slides;

a non-slide portion over which the fixing rotator does not slide;

a first face contacting the fixing rotator, the first face weaved with a first fiber; and a second face contacting the nip former, the second face weaved with a second fiber that is exposed on and weaved into at least a part of the non-slide portion on the first face, wherein the slide member further includes warp disposed substantially parallel to a slide direction in which the fixing rotator slides over the slide member, and weft disposed substantially perpendicular to the slide direction of the fixing rotator, and wherein the warp is exposed on the first face of the slide member and the weft is not exposed on the first face of the slide member.

17. An image forming apparatus comprising the fixing device according to claim 1.

* * * * *